United States Patent [19]

Berstein

[11] Patent Number: 4,782,682

[45] Date of Patent: Nov. 8, 1988

[54] ROLLING MILL TOOL

[75] Inventor: Garri Berstein, Erkelenz, Fed. Rep. of Germany

[73] Assignee: Wilhelm Hegenscheidt Gesellschaft mbH, Erkelenz, Fed. Rep. of Germany

[21] Appl. No.: 49,699

[22] Filed: May 13, 1987

[30] Foreign Application Priority Data

Jul. 19, 1986 [EP] European Pat. Off. ..... 86109931

[51] Int. Cl.[4] ..... B21H 1/00

[52] U.S. Cl. ..... 72/110

[58] Field of Search ..... 72/80, 81, 102, 110, 72/111, 365, 366, 107

[56] References Cited

U.S. PATENT DOCUMENTS 3,735,620 5/1973 Naumann ..... 72/107

FOREIGN PATENT DOCUMENTS 1347 1/1970 Japan ..... 72/110

*Primary Examiner*—Lowell A. Larson

*Attorney, Agent, or Firm*—W. G. Fasse; D. H. Kane, Jr.

[57] ABSTRACT

A rolling mill tool for smooth rolling slightly convexly or concavely curved surfaces of rotationally symmetric work pieces, such as bearing journals of crankshafts, has a milling roller with a slender and hence flexing configuration for conforming the shape of the milling roller to the curved shape of the work piece surface. Such a milling roller achieves a satisfactory rolling force or load distribution. The rolling force which is applied to the milling roller by a support roller is sufficient to flex the milling roller along its lengthwise axis to assume the shape of the contour of the work piece.

12 Claims, 3 Drawing Sheets

ROLLING MILL TOOL

FIELD OF THE INVENTION

The invention relates to a rolling mill tool for the plunging type roller milling of shaft journals, especially crankshaft bearing journals and other rotating work pieces.

DESCRIPTION OF THE PRIOR ART

Such rolling mill tools for rolling shaft journals have at least one rolling drum or milling roller which is pressed against a work piece with a specified rolling or milling force and, at least one first support roller resting against and supporting the work piece, and at least one second support roller for pressing the rolling drum or milling roller, whereby the second support roller for the rolling drum has a surface shape deviating from a flat cylindrical shape.

Rolling mill tools of the above described type, as well as the machines necessary for operating such rolling mill tools, are known through German Patent Publication (DE-PS) No. 2,146,994. However, rolling tools of this known type are only suitable either for rolling cylindrical shaft journals, or for rolling cylindrical shaft journals in such a way that the cylindrical shaft journal is slightly convexly shaped after the rolling operation. In other words, the milled surface bulges slightly radially outwardly.

In many cases and especially for crankshaft bearing journals, the surfaces of the journal pins are formed to have a slightly concave or convex shape in order to influence the edge pressure and thereby the bearing wear. The deviation of such concave or convex shaped journal surfaces from a perfect cylindrical shape only entails a few microns, for example, 8 microns. The respective magnitude of the deviation of such journals from the perfect cylindrical shape must be very accurately maintained, because this deviation is based on extensive experience in the functioning of the related crankshaft. Such a deviation of the bearing journal surface from a cylindrical shape cannot be achieved with sufficient accuracy by means of a correspondingly shaped rolling drum, as is, for example, described in the German Patent Publication (DE-PS) No. 2,146,994, FIG. 5. Pre-machiningtolerances and inhomogeneities of the material make the results of the rolling operation unsure or inconsistent. The elastic deformability of the work piece furthermore makes it nearly impossible to determine and set the appropriate rolling drum or milling roller contour.

However, it is also not possible for a rolling drum according to FIG. 5 of the above named German Patent Publication (DE-PS) No. 2,146,994 to roll or mill an appropriately pre-curved surface, because the curvature of the surface to be rolled and the curvature of the rolling drum are not identical to each other so that a non-uniform load distribution results and leads to an unsatisfactorily rolled or milled product.

U.S. Pat. No. 4,299,017 (Gottschalk) describes a milling apparatus in which the present tool can be used.

OBJECTS OF THE INVENTION

In view of the foregoing it is the aim of the invention to achieve the following objects singly or in combination:

to provide an improved rolling mill tool for rolling or milling the pre-machined, slightly convexly or concavely curved surfaces of shaft journals or journal pins with a high degree of accuracy of curvature and surface smoothness, and with a uniform rolling load distribution;

to avoid unpermissible deviations from the curvature, or rather, from the surface contour of the journal pin;

to allow one rolling drum of such a rolling mill tool to effectively roll many different shapes of precurved surfaces of shaft journals or journal pins; and to avoid the effects of material parameters, such as pre-machining tolerances, inhomogeneities, and elastic deformability, on the final rolling results of such a rolling mill tool.

SUMMARY OF THE INVENTION

The above objects have been achieved in a rolling mill tool, wherein according to the invention, the smoothing rolling drum or milling roller is relatively long and narrow so that it is elastically deformed or flexed relative to its lengthwise axis due to the rolling force transmitted through the support roller. Due to this deformation, the rolling drum or milling roller evenly contacts the curved shape of the work piece. A pressure application roller for the rolling drum referred to above as the second support roller, is shaped so that it allows the described elastic flexing of the rolling drum or milling roller. Because the range of the flexing in this case is very small, a narrow, slender, and for example cylindrical, rolling drum may be easily flexed to precisely follow the contour of the work piece to be rolled. It has been demonstrated that the original contour of the work piece is very accurately maintained, so that the contours of the work pieces may be pre-machined in a known and effective manner and then rolled smooth as desired by means of the present invention without introducing unallowable contour alterations.

According to one embodiment of the invention, the second support roller for the rolling drum comprises a contact shoulder at each of its two ends for supporting surfaces of the rolling drum. Furthermore, a middle section of the second support roller has such diameter dimensions that the desired elastic flexing of the rolling drum or milling roller is possible. This embodiment is advantageous and effective for smooth-rolling convex-shaped journal bearing surfaces. The contact shoulder protruding radially from each end of the support roller supports the smooth-rolling drum or milling roller for pressing the smooth-rolling drum against the surface contour of the journal to be smooth-rolled. As has been demonstrated b practical experiment, the contour may thus be rolled without introducing any unallowable shape deformations.

As a further advantageous detail, it is suggested that the contact surface of each contact shoulder comprises a convex curved shape. This is an advantageous embodiment for relatively small radii of curvature of the surface to be rolled.

Alternatively, the contact surface of each contact shoulder may have a cylindrical shape. This feature simplifies the production of the tools, especially the second support rollers, and yet a satisfactory working life is achieved, especially for relatively large radii of curvature of the work piece.

Another embodiment provides that the contact surface of each contact shoulder is conical in shape, tapering toward the other contact shoulder at the other end of the second support roller. The conical angle is sufficiently large to allow for the desired elastic flexing of the rolling drum or milling roller. This embodiment is suitable for relatively large, as well as relatively small, radii of curvature of the cross-sectional shape of a longitudinal section through the rotational axis of the work piece, whereby the conical angle may be correspondingly adapted to any radius of curvature.

In order to roll concavely shaped outer bearing surfaces of journals, the present invention provides that the second support roller for the rolling drum has a convex barrel-like shape, whereby the radius of curvature of the second support roller is equal to or smaller than the radius of curvature of the sectional profile of the work piece as seen in a longitudinal section through the axis of rotation of the work piece. Due to the convex shape of the second support roller, a flexing of the rolling drum is achieved as described, to the extent necessary so that the rolling drum rests cleanly and uniformly against the contour of the work piece surface, whereby the surface of the work piece is rolled smooth without any unallowable contour alterations.

In a further embodiment of the invention the second support roller for the rolling drum or milling roller is constructed as an assembly of two conical sections arranged coaxially and with their larger ends or bases facing each other. The base surfaces of the conical sections are connected by a cambered or by a cylindrical central disk. The conical angle of the conical sections is large enough for permitting a flexing of the rolling drum for fitting the contour of the work piece surface. Support rollers of such a form and construction may be produced in a simple manner, and assure uniform contact of the rolling drum against the contour of the work piece. Such uniform contact provides an advantageous rolling force distribution, especially with wide bearing journals and large radii of curvature of the longitudinal sectional contour of the work piece.

It is further provided by the invention that the first type of support roller which bears against the work piece, has a surface shape fitting the contour of the work piece with a concàve or convex camber. In the case of a concave shaped first support roller, the radius of curvature of the first support roller is larger than the respective radius of the convex curvature of the work piece surface. In the case of a convex shaped first support roller, the radius of curvature of the first support roller is smaller than the respective radius of the concave curvature of the work piece. Due to these relations of the radii of curvature, an improved load or rolling force distributions is achieved along the support rollers. Upon setting up the tool it is important that the ratio of the rolling drum diameter to the first support roller diameter is such that the first support roller causes exclusively an elastic deformation of the work piece, thereby avoiding any plastic deformation of the work piece by the first support roller. Fitting the first support roller contour to the work piece contour allows a reduction of the diameter of the first support roller contacting the work piece, whereby the structural space required by the tool may be reduced.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
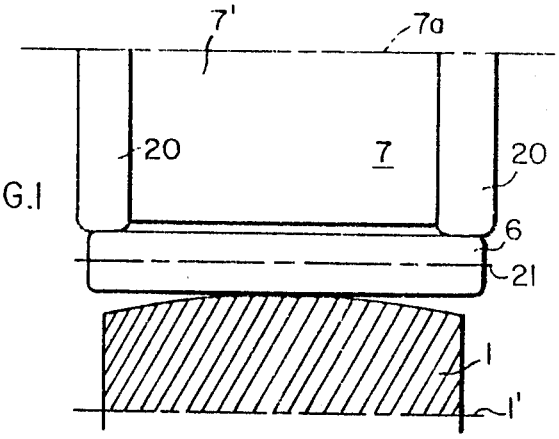
FIG. 1 is a side view of a rolling mill tool according to the invention for rolling a work piece with a convex surface contour shown in a longitudinal axial sectional view, the tool having a second support roller with projecting cylindrical contact shoulders, the first support roller for the work piece is not shown.

FIG. 1 shows a partial side view, or more specifically, a view of the lower half of a second support roller 7 with its dash-dotted rotation axis 7*a* forming the upper edge of the view. The second support roller 7 supports a milling roller or rolling drum 6. A first support roller 3,3′ shown in FIGS. 7, 8 supports a work piece l or 2 directly, while the second support roller supports the work piece only indirectly through the milling roller 6. The second roller 7 essentially comprises a central or main section 7′ which is, for example, cylindrical and two axial end sections forming radially protruding contact shoulders 20 for supporting the milling roller 6.

The contact shoulders 20 of the pressure or support rollers 7 are larger in diameter than the central section 7′ and therefore protrude radially outwardly beyond the surface of the central section 7′. The circumferential surface of each contact shoulder 20 in FIG. 1 is cylindrical. The cylindrical circumferential contact surfaces of the shoulders 20 rest against a cylindrical rolling drum or milling roller 6 having its longitudinal axis 21 parallel to the rotational axis 7*a* of the pressure or support roller 7. The arrangement of the rolling mill tool, as for example shown in U.S. Pat. No. 4,299,017 serves to press the rolling drum 6 against the work piece 1 which may, for example, be the bearing journal or pin of a crankshaft. In the view of FIG. 1, only the upper half of the journal or work piece 1 is shown, whereby the rotation axis 1′ of the work piece 1 is at the lower edge of the Figure. A lengthwise section through the rotation axis of the work piece 1 shows the convexly curved outer surface contour of the work piece 1 which is strongly exaggerated in FIG. 1. In actuality, the curvature only amounts to a few microns, e.g. eight microns. The work piece 1 is smooth rolled, as is usual, in a single-pass or rather plunging type of operation. In order to achieve this smooth rolling, the second pressure or support roller 7 is pressed radially against the rolling drum 6 with a force sufficient to provide the required rolling or milling force. Under the effect of this rolling force, the rolling drum 6 is pushed against the highest points of the contour of the work piece 1 and rests against that point. The rolling force, which is transmitted through the contact shoulders 20 to the smooth-rolling drum 6 causes the drum 6 to flex around, so to speak, the contour of the work piece 1. Because the rolling drum 6 is slender, only a relatively small force is required to effectively flex the rolling drum 6 to fit the contour of the work piece 1. After such flexing has been achieved and the rolling drum 6 is resting in full contact along the convex curvature of the work piece 1, the rolling force builds up and then the actual rolling process may be carried out. The pressure roller 7, the rolling drum 6, and the work piece 1 are all set into rotating motion, whereby the total circumferential surface of the work piece 1 is smooth rolled without any danger of causing any unallowable alternation of the convex contour of the work piece 1.

Figure 2:
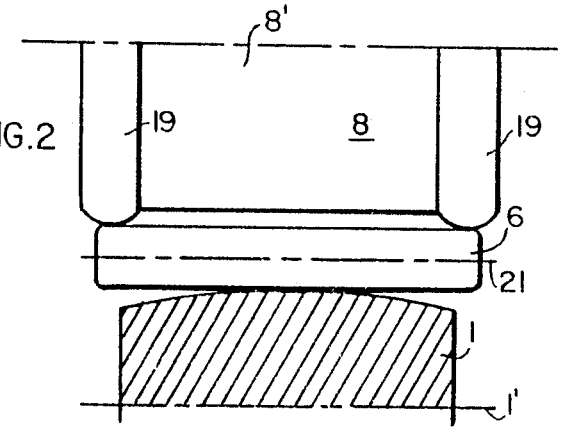
FIG. 2 is a view similar to that of FIG. 1, but showing a second support roller having projecting contact shoulders with a curved or rounded cross-sectional contact surface.

The structure, as well as the operating mode of a rolling mill tool as shown in FIG. 2 is similar to that shown in FIG. 1. However, in FIG. 2 a second pressure support roller 8 has a cylindrical central section 8' flanked at its ends by contact shoulders 19 having cambered or rounded circumferential surfaces for contacting the rolling drum 6. Thus, each makes a single point, or rather, a line contact with the rolling drum 6 when rotating. This arrangement and shape of the contact shoulders 19 is especially advantageous for the rolling of narrow work pieces 1 having a relatively small radius of curvature of the longitudinal sectional contour. In such cases, the rounded shape of the contact shoulders 19 serves to prevent an undesirable pressure concentration in the edge or end zones of the cylindrical shoulders 19 when the rolling force is transmitted through the shoulders 19 for pressing the rolling drum 6 against the contour of the work piece 1. Again in FIG. 2, as in FIG. 1, the central section 8' of the second pressure or support roller 8 has a smaller radius than the contact shoulders 19, so that the central section 8' does not hinder the flexing of the rolling drum 6 and its hugging or resting against the contour of the work piece 1. It should be mentioned here that it is not necessary that the respective central section 8' between the contact shoulders is cylindrical. The central section 8' must simply have such a shape and size that the rolling drum 6 remains free to flex.

Figure 3:
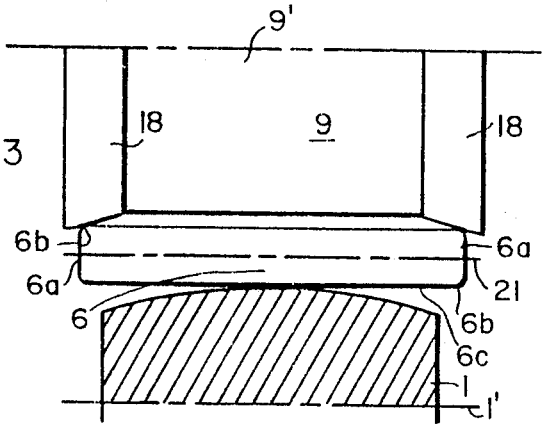
FIG. 3 is a view similar to that of FIG. 1, but showing a second support roller having conical shaped protruding contact shoulders.

FIG. 3 shows a way for combining the advantages of the embodiments of FIGS. 1 and 2. The general structure and mode of operation of the rolling mill tool according to FIG. 3 is similar to that of FIGS. 1 and 2. In FIG. 3, a second pressure or support roller 9 has a central section 9' which is bounded at its ends by contact shoulders 18. The circumferential surfaces of these contact shoulders 18 are, however, respectively oppositely directed conical sections. The conical taper of each contact shoulder 18 is directed axially inwardly toward the opposite contact shoulder 18. The transition **6*b* or edge between the end faces 6*a* and the cylindrical circumferential surface 6*c* of the rolling drum 6 may be rounded. Such a rounded edge is advantageous, because then the rolling drum 6 may be fully as long as the second pressure or support roller 9, while the point of contact between the rolling drum 6 and the support roller 9 is shifted axially inwardly onto the conical circumferential surfaces of the contact shoulder 18. The central section 9' of the support roller 9 is again of such dimensions that the necessary flexing of the rolling drum 6 is not hindered. The slope angle of the conical circumferential surfaces of the contact shoulders 18 is also appropriately dimensioned. Due to the rolling mill tool construction as just described undesirable edge pressure concentrations between the rolling drum 6 and the second support roller 9 are prevented. Simultaneously, the support roller 9** has a relatively simple contour which may be easily produced.

Figure 4:
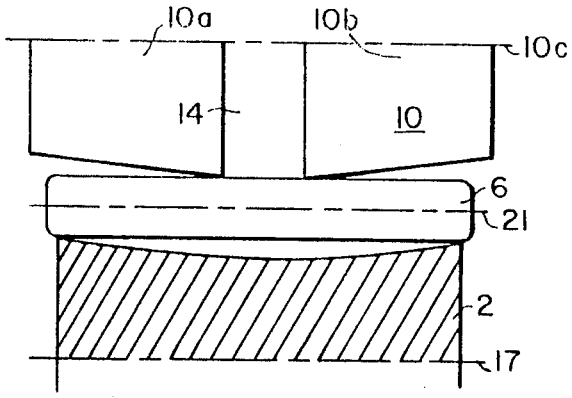
FIG. 4 is a view similar to that of FIG. 1, but showing a second support roller for rolling a work piece having a concave surface contour, said second support roller having two conical sections and a cylindrical central disk.
Figure 5:
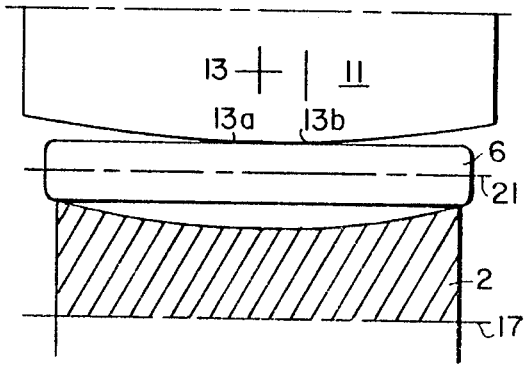
FIG. 5 is a view similar to that of FIG. 4, however, the edge of the base of each conical section is rounded to avoid pressure concentrations.
Figure 6:
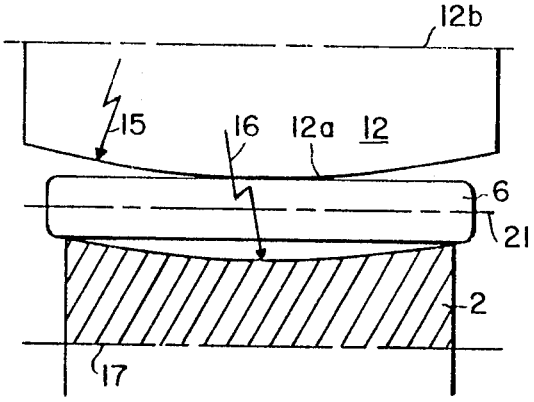
FIG. 6 is a view similar to that of FIG. 5, however, the second support roller has a continuous convex curved barrel-shaped surface.

The FIGS. 4 to 6 show another arrangement of a rolling mill tool for rolling a journal or work piece 2 having a concave curved longitudinal sectional shape. Such a work piece may, for example, again be a concavely curved crankshaft bearing journal. The general structure and operation of these embodiments is similar to that described with reference to FIGS. 1–3. FIGS. 4, 5, and 6 show a rolling mill tool having a cylindrical rolling drum or rolling pin 6 and a cooperatively arranged second pressure or support roller 10, 11, 12, respectively. The respective support roller 10, 11, 12, flexes and presses the rolling drum 6 against the concavely curved contour of a work piece 2. The work piece 2 is rolled smooth without any danger of an unallowable alteration of the concave longitudinal sectional shape.

In the embodiment of FIG. 4, the support roller 10 essentially comprises two concial frustums **10*a* and 10*b* having a common rotation axis 10*c* and joined at their wider bases by a central disk 14 of the support roller 10. In the embodiment of FIG. 4**, the central disk has a cylindrical shape.

The embodiment of FIG. 5 corresponds substantially to that shown in FIG. 4, however, the double-ended conical support roller 11 has a cylindrical central section 13 with rounded transition edges **13*a* and 13*b***, whereby again pressure concentrations are avoided.

FIG. 6 shows a second pressure or support roller 12 having a surface **12*a* which is cambered or convexly curved, whereby the radius of curvature 15 of the support roller 12 may be equal to the radius of curvature 16 of the work piece 2. Preferably, however, the radius of curvature 15 of the support roller 12 is smaller than the radius of curvature 16 of the work piece 2. A second support roller 12 as shown in FIG. 6, having a continuous convex curvature, is most advantageous for simply and effectively compensating for slight errors in the parallel alignment of the rotation axis 17 of the work piece 2 and of the rotation axis 12*b* of the second support roller 12**.

Figure 7:
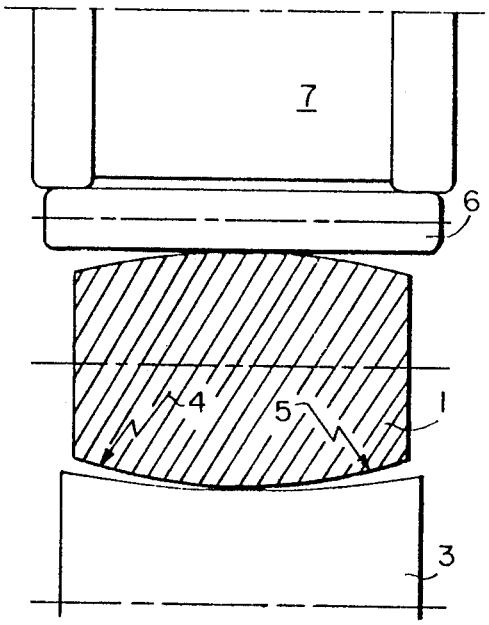
FIG. 7 is a sectional view of the rolling mill tool according to the invention as in FIG. 1, but also showing the arrangement of a first support roller for supporting the work piece.

A rolling mill tool of the general construction as shown in FIG. 1 is again shown in FIG. 7. However, the view of FIG. 7 shows the above mentioned first support roller 3 in direct contact with and supporting the work piece 1. The first support roller 3 has a concave curvature corresponding to the convex curvature of the work piece 1. More specifically, the radius of curvature 4 of the concave surface of the first support roller 3 is larger than the radius of curvature 5 of the work piece 1. The use of such a first support roller 3 facilitates achieving advantageous contact positioning between the work piece and the second milling roller 7.

Figure 8:
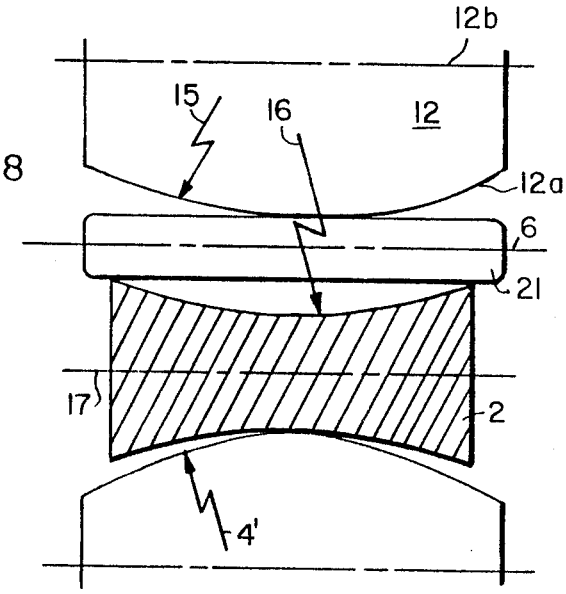
FIG. 8 is a view similar to FIG. 7 but according to the invention as in FIG. 6.

A rolling mill tool of the general construction as shown in FIG. 6 is again shown in FIG. 8. However, the view of FIG. 8 shows the above mentioned first support roller 3' in direct contact with and supporting the work piece 2. The first support roller 3' has a convex curvature corresponding to the concave curvature of the work piece 2. More specifically, the radius of curvature 4; of the convex surface of the first support roller 3' is shorter than the radius of curvature 16 of the work piece 2. The use of such a first support roller 3' also facilitates achieving advantageous contact positioning between the work piece and the second milling roller 12.

Through the use of rolling mill tools of the type described, it is possible to smooth rool journals, for example crankshaft bearing journals, having a slightly curved outer surface as seen in an axial section through the respective rotation axis. Furthermore, any undesirable contour alterations or deformations are prevented. The desired contour is maintained with the required accuracy during the the smooth rolling operation, so that the previously used premachining methods for pre-machining the work piece may be employed as before. The rolling tool itself has a simple structure and may be produced in a cost efficient manner.

The dimensions of the milling roller 6 for obtaining the slenderness required for the present purposes will depend primarily on the dimensions of the particular work piece. In any event, the milling roller 6 must be able to flex in accordance with the surface contour of the work piece. Ratios of the length of the roller 6 to its diameter in the range of 3–12 have been found to be suitable for the present purposes.

Although the invention has been described with reference to specific example embodiments, it will be appreciated that it is intended to cover all modifications and equivalents within the scope of the appended claims.

What I claim is:

1. A rolling mill tool, comprising rotatable milling roller means for smooth rolling a contoured surface of a journal, pressure application roller means mounted for pressing said milling roller means against said contoured surface, said milling roller means having a length to diameter ratio sufficient for flexing and conforming a flexed shape of said milling roller means to said contoured surface of said work piece, said pressure application roller means having a configuration for permitting and causing said flexing of said milling roller means, said tool further comprising support roller means arranged for directly contacting said journal.

2. The rolling mill tool of claim 1, wherein said pressure application roller means comprises a central section and two end sections flanking said central section, said end sections forming shoulders having a diameter larger than said central section for contacting ends of said milling roller means and for permitting said milling roller means to flex.

3. The rolling mill tool of claim 2, wherein said shoulders have a tire type configuration with a convex radially outwardly facing surface for contacting said ends of said milling roller means.

4. The rolling mill tool of claim 2, wherein said shoulders have a cylindrical configuration for contacting said ends of said milling roller means.

5. The rolling mill tool of claim 2, wherein each of said shoulders has a conical surface arranged so that tips of respective cones point toward each other and larger diameter cone base surfaces face axially outwardly relative to a rotational axis of said milling roller means, each said conical surface having a conicity sufficient to permit said flexing of said milling roller means.

6. The rolling mill tool of claim 1, wherein said contoured work piece surface has a concave configuration in its longitudinal axial section, said concave configuration having a given first radius of curvature, said pressure application roller means having a cambered, convex configuration in its longitudinal axial section, said convex configuration having a second radius of curvature about equal to said first radius of curvature.

7. The rolling mill tool of claim 1, wherein said contoured work piece surface has a concave configuration in its longitudinal axial section, said concave configuration having a given first radius of curvature, said pressure application roller means having a cambered, convex configuration in its longitudinal axial section, said convex configuration having a second radius of curvature shorter than said first radius of curvature.

8. The rolling mill of claim 1, wherein said contoured work piece surface has a concave configuration in its longitudinal axial section, said pressure application roller means comprising two conical frustums and a central section between said conical frustums, said conical frustums having a large diameter base facing said central section and a small diameter end facing away from said central section, said conical frustums having a conicity sufficient to permit said flexing of said milling roller means for conforming to said concave surface contour.

9. The rolling mill tool of claim 8, wherein said central section has a cylindrical surface.

10. The rolling mill tool of claim 8, wherein said central section has a cambered surface with rounded corners.

11. The rolling mill tool of claim 1, wherein said contoured surface of said journal has a concave configuration with a given first radius of curvature, said support roller means having a convex configuration with a second radius of curvature smaller than said first radius of curvature of said contoured surface.

12. The rolling mill tool of claim 1, wherein said contoured surface of said journal has a convex configuration with a first radius (5) or curvature, said support roller means having a concave configuration with a second radius (4) of curvature larger than said first radius (5) of curvature of said contoured surface.

* * * * *